US005383407A

United States Patent [19]

Souchal

[11] Patent Number: 5,383,407

[45] Date of Patent: Jan. 24, 1995

[54] CABLEWAY CABINS FOR TRANSPORT OF PASSENGERS

[75] Inventor: Jean Souchal, Grenoble, France

[73] Assignee: Pomagalski S.A., France

[21] Appl. No.: 98,037

[22] Filed: Jul. 28, 1993

[30] Foreign Application Priority Data

Aug. 20, 1992 [FR] France ..... 92 10336

[51] Int. Cl.[6] ..... B61B 7/00

[52] U.S. Cl. ..... 105/149.1

[58] Field of Search ..... 104/173.1, 184; 105/150, 148, 149.1, 149.2

[56] References Cited

U.S. PATENT DOCUMENTS

| | | | |
|---|---|---|---|
| 3,094,079 | 6/1963 | Greil | 105/150 |
| 4,149,471 | 4/1979 | Tauzin et al. | 105/149.1 |
| 4,391,200 | 7/1983 | Bajulaz | 105/149.1 |
| 4,503,778 | 3/1985 | Wilson | 104/28 |

FOREIGN PATENT DOCUMENTS

| | | | |
|---|---|---|---|
| 0497713 | 8/1992 | European Pat. Off. . | |
| 1442814 | 5/1966 | France | 105/149.1 |
| 1454500 | 10/1966 | France | 105/149.1 |
| 2240133 | 3/1975 | France . | |
| 858418 | 1/1961 | United Kingdom . | |
| 0893643 | 12/1981 | U.S.S.R. | 105/149.1 |

*Primary Examiner*—Mark T. Le

*Attorney, Agent, or Firm*—Parkhurst, Wendel & Rossi

[57] ABSTRACT

A cableway cabin especially for a gondola lift has an asymmetrical shape with reference to the vertical median plane extending in the direction of travel of the cabin. The width of the inner lateral side of the cabin, which faces the inner side of the curve when the cabin travels on the half-loop circuit, is smaller than the width of the opposite lateral side. Two benches are disposed against the front and the rear sides of the cabin and the space between the two passengers seated near the inner lateral side is just sufficient for the feet of the passenger while on the other side of the cabin, equipped with the door, an open space is provided in front of the door for access of the passengers.

7 Claims, 3 Drawing Sheets

CABLEWAY CABINS FOR TRANSPORT OF PASSENGERS

BACKGROUND OF THE INVENTION

The invention relates to a cabin or gondola especially for a cableway or gondola lift, running continuously in a closed circuit between a starting and an arrival station. The cabins, supported by carriages with grips, are coupled to the cable on the circuit and de-coupled or released from the travelling cable at the stations. The carriages, supporting the cabins, travel through the station at low velocity on a half-loop circuit linking the up and down tracks before being accelerated and reattached to the cable as they leave the station. Transport installations of this kind have a high conveying capacity, due to the large number of cabins running on the closed circuit and to the comparatively high velocity of movement of the travelling cable. This conveying capacity is inversely proportional to the time interval between successive cabins, which is constant throughout the entire closed loop path of the cableway. It is clear that the cabins approach much closer to one another when the cabin velocity is smaller, and that the time interval is thus limited by the low travel velocity in the station, the outline dimensions of the cabins and the necessity to travel on the curved sections without the cabins collide.

For increasing the transport capacity it has already been proposed to reduce the time interval by increasing the cabin travel velocity through the station,by approaching the cabins much closer to one another in the station, and/or by reducing the cabin width. The stepping in and out of the passengers may be dangerous when the cabin travel velocity is too high. Further the spacing between two successive cabins must be sufficient to allow, the passage of the cabins along the curved section of the half-loop circuit. When the cabin width is small the change of passengers is effected slowly.

It has been noted that the passengers entering the cabin always sit down on the seats near the door and hinder the access to the other seats. When the cableway has intermediary stations and/or when the cabin provides accomodation for an increased number of passengers, for instance six or more passengers, the seats distant from the door are often unoccupied and the actual transport capacity is thus reduced. It has already been proposed to increase the width of the cabin to allow entry into and egress from the cabin, even if passengers are seated near the door, but as already mentioned the cableway transport capacity is accordingly smaller.

It is an object of the present invention to provide a cabin which permits easy passenger access even if the seats near the door are occupied, so that the cabin does not leave the station with some seats unoccupied.

A further object of the invention is to provide a cabin which may travel along the curve of the half-loop circuit without increasing the spacing or the travel velocity of the cabins. In such a case the cableway transport capacity is not reduced. Further, the embarking and disembarking sections can extend along the curve and the length of the station is reduced.

SUMMARY OF THE INVENTION

The cableway cabin according to the invention comprises a cabin body having a floor, a roof and outer walls, said outer walls forming a front side, a rear side, a first lateral side, facing during the travel of the cabin on the curved section said inner side of the curved section, and a second lateral side, facing during the travel of the cabin on the curved section said outer side of the curved section. A door opening is disposed along the second lateral side, and a pair of seating means having seatbacks is disposed face to face inside said cabin body such that said seatbacks are against said front and rear sides, said pair of seating means defining an open space in front of said door opening. The cabin body is asymmetrical with reference to a vertical median plane extending in the direction of travel of the cabin, said first lateral side having a width smaller than the width of said second lateral side and said pair of seating means, adjacent to said first lateral side, defining a space just sufficient for the feets of the passengers seated near said first lateral side.

An advantage of the invention resides in the fact that the cabins travel at a constant low velocity along the transfer rail, which constitutes the half-loop circuit, while the spacing of the successive cabins remains the same on the straight and on the curved sections of the transfer rail. The means of the half-loop circuit, which conveys the cabins at a substantially constant velocity, are the conventional cost favorable friction drive wheels or drive chains. A further advantage is that the embarking section and the disembarking section may extend along the curved section and that there can be constructed shorter stations.

The asymmetrical cabin shape provides a comfortable wide side near the door and the passengers can step in and out easily and rapidly even if the seats near the door are occupied. This wide portion does not hinder the passage along the curved section.

The cabin is advantageously symmetrical with reference to the vertical median plane extending perpendicular to the direction of travel of the cabin and the access is provided by means of a two sliding door panel. The cabin has at least six seats and advantageously eight seats or a pair of benches for eight passengers and the skis are secured outside the cabin, for instance in ski racks provided on the door panels.

The front side and the rear side of the cabin, each is slightly convexly curved and extends with increased curvature to the first lateral side, in such a manner that the seats near the first lateral side are inclined with respect one to another to provide more space for the feets. A similar seat inclination is provided on the door side. The front side and the rear side of the cabin, each has a part which is disposed on the inner side of the vertical median plane in the direction of travel and which converges towards the first lateral side so that these parts are substantially in contact when the cabin moves along the curved section. The opposite parts of the front and rear sides are substantially parallel.

BRIEF DESCRIPTION OF THE DRAWINGS

The attached drawings show by way of example an embodiment of the present invention in which.

BRIEF DESCRIPTION OF THE PREFERRED EMBODIMENT

Figure 5:
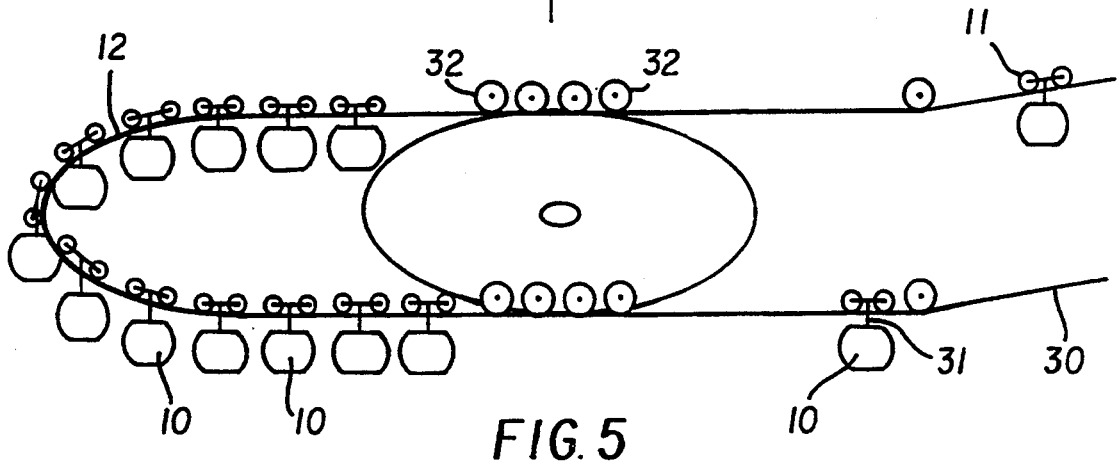
FIG. 5 is a general perspective view of a gondola lift terminal.

In the drawings a cabin 10 of a cableway or a gondola of a gondola lift is fixed by a hanger arm 31 to a carriage 11 bearing a grip coupling it to an overhead haulage-track cable 30. The grips are of the detachable type permitting uncoupling of the carriage 11 from the cable at the entrance in the terminals and the running at a slow speed on a transfer rail 12 joining the up and down tracks. The transfer rail extends in a half-loop in the terminal and platforms for loading or unloading passengers are located along the rail particularly along the semi-circular end section. The carriages 11 are driven at slow speed for instance by friction drive sheaves 32 or a drive chain, which decelerate the cabins at the entrance in the terminal or station and accelerate the cabins at the exit. The cabins 10 are practically in abutment while travelling along the half-loop circuit. Such a cableway, shown in FIG. 5, is well known and for instance described in the U.S. Pat. No. 4,627,361.

The cabin 10 possesses a floor 33, a roof 34, two mutually opposed sidewalls, forming a first lateral side 16 and a second lateral side 17, and two end walls, forming a front side 14 and a rear side 15. A seat 18,19 is arranged in the interior of the cabin at each end wall 14,15 which, for instance, can be constructed as a bench for four passengers 13 so that in total eight passengers can be seated in the cabin. Passengers 13 are seated back to the wall and thus substantially face to face. It is clear that the cabin could be equipped with seating accomodation for six or more passengers.

During the travel along the curve of the half-loop circuit the second lateral side 17 is located at the outer side of the curve and this second lateral side is provided with a door opening which is closeable by a door having two sliding panels 20. Each door panel 20 may be provided with a ski rack 21 at its lower portion on its exterior side, whereby the ski rack 21 may comprise pockets for inserting , for instance, four pairs of skis. When opening the door panels 20, they are slid away from one another in the horizontal direction so that they expose a door opening whose width is approximately equal to the dimension of the intervening space between the two benches 18,19. The framework 22 of the cabin is incorporated in or constituted by the cabin walls so that the passenger finds no obstacles when entering the cabin.

The cabin 10 is symmetrical with reference to the vertical median plane X—X extending perpendicular to the direction of travel indicated by an arrow. The cabin is dissymmetrical with reference to the vertical median plane Y—Y extending in the direction of travel, in such a manner that the width of the second lateral side 17, having the door opening, is larger than the width of the first lateral side 16, which faces the inner side of the curve when the cabin 10 travels along the half-loop circuit. The width of the cabin is substantially constant in the part 27 between the second lateral side 17 and the vertical median plane Y—Y in the direction of travel and this width decreases in the part 26 between this vertical plane Y—Y and the first lateral side 16. The width of the first lateral side 16 is just sufficient to provide between the benches 18,19, near this lateral side 16, a space for the feet of the passengers 13 seated on this side. The width of the second lateral side 17 is sufficient to define an open space 23, in front of the door opening, between the seated passengers on this side of the cabin, to allow the passage of the other passengers. It is clear from these width differences that the front 14 and rear 15 walls are substantially parallel in the part of constant width and that these walls 14,15 converge toward the first lateral side 16 in the other part of the cabin. The front 14 and rear 15 walls are slightly convexly curved in horizontal section and the curvature 24 increases near the first lateral side 16 so that the passengers are seated substantially in the direction of the cabin center, inclined with respect to the travel direction, and having more place for their feet. In the same manner, the front 14 and rear 15 walls are advantageously slightly curved near the second lateral side 17 as shown at 25 in the drawings.

Figure 1:
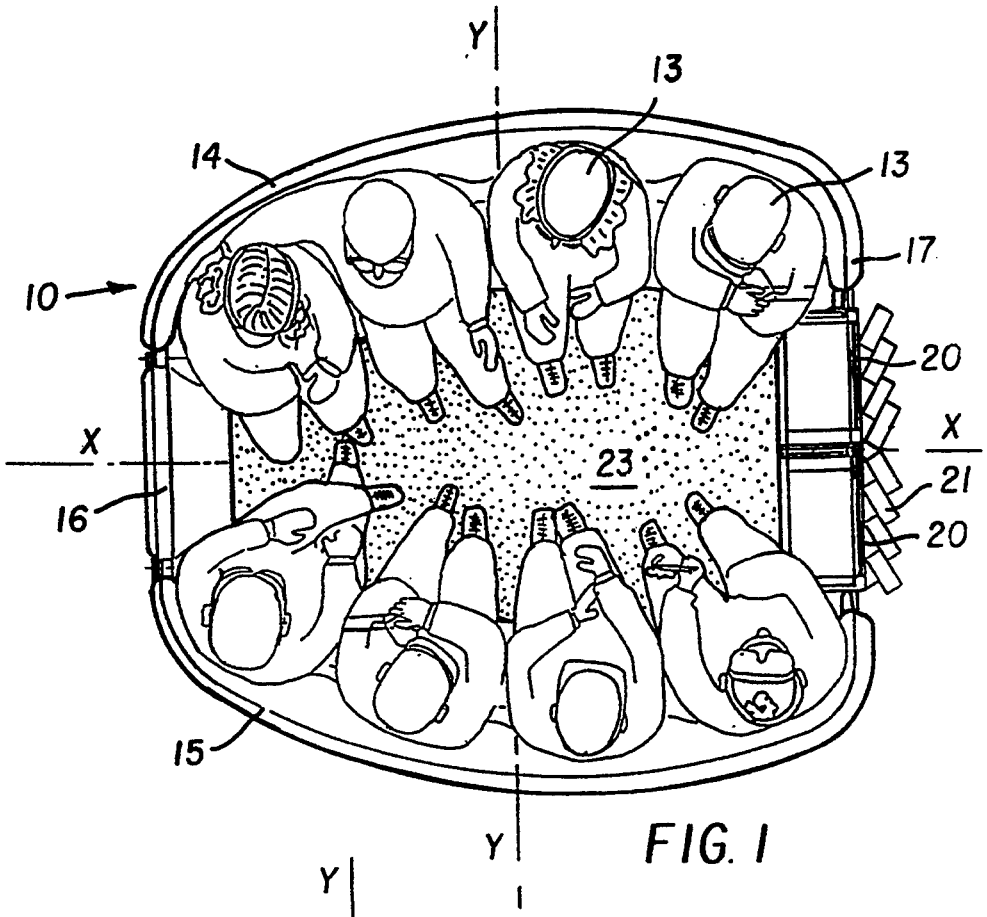
FIG. 1 shows a diagrammatical cross section of a cabin according to the invention taken along a line 1—1 of FIG. 4.
Figure 2:
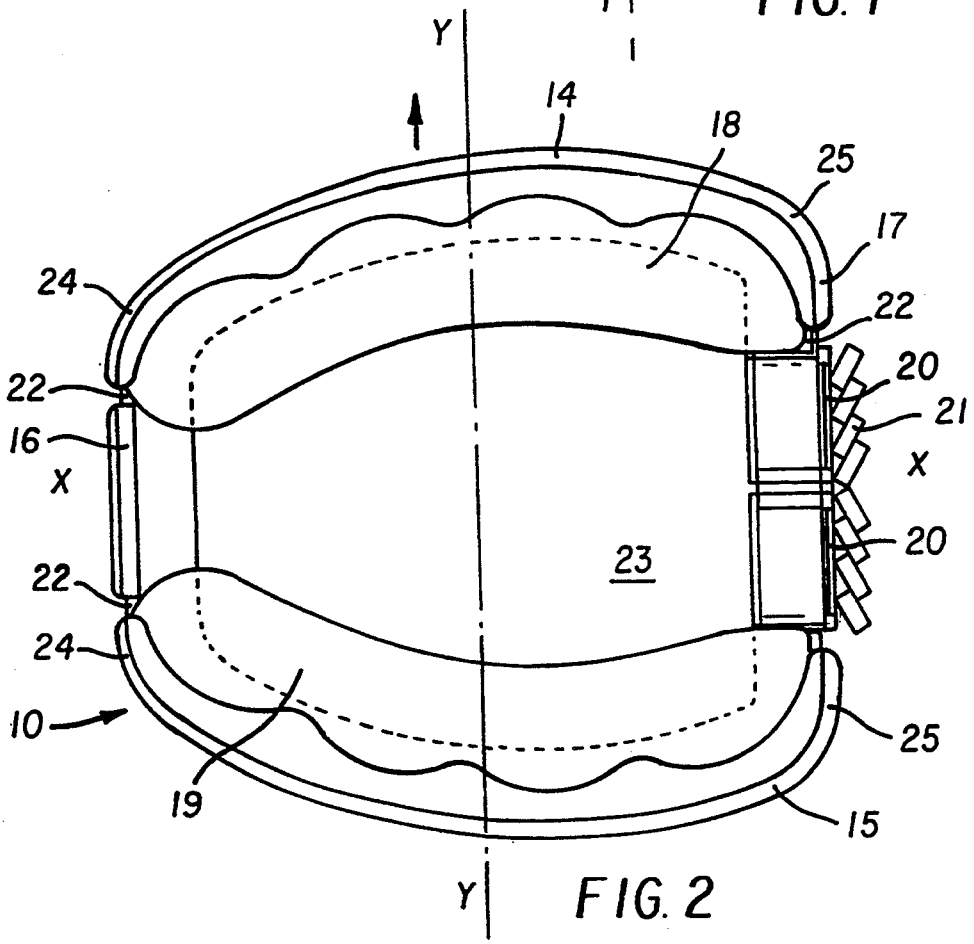
FIG. 2 is a similar view to that of FIG. 1 showing the cabin without passengers.

As illustrated in FIG. 1 the central part 23 of the cabin in front of the door opening is free even if passengers are seated near the door, and other passengers may leave or enter into the cabin, for instance at an intermediary station.

The cabin can be designed for a lesser or greater number of passengers and the horizontal expanse of the front wall 14 and rear wall 15, transverse to the direction of travel, can be correspondingly modified, while the remaining dimensions can remain the same.

Figure 3:
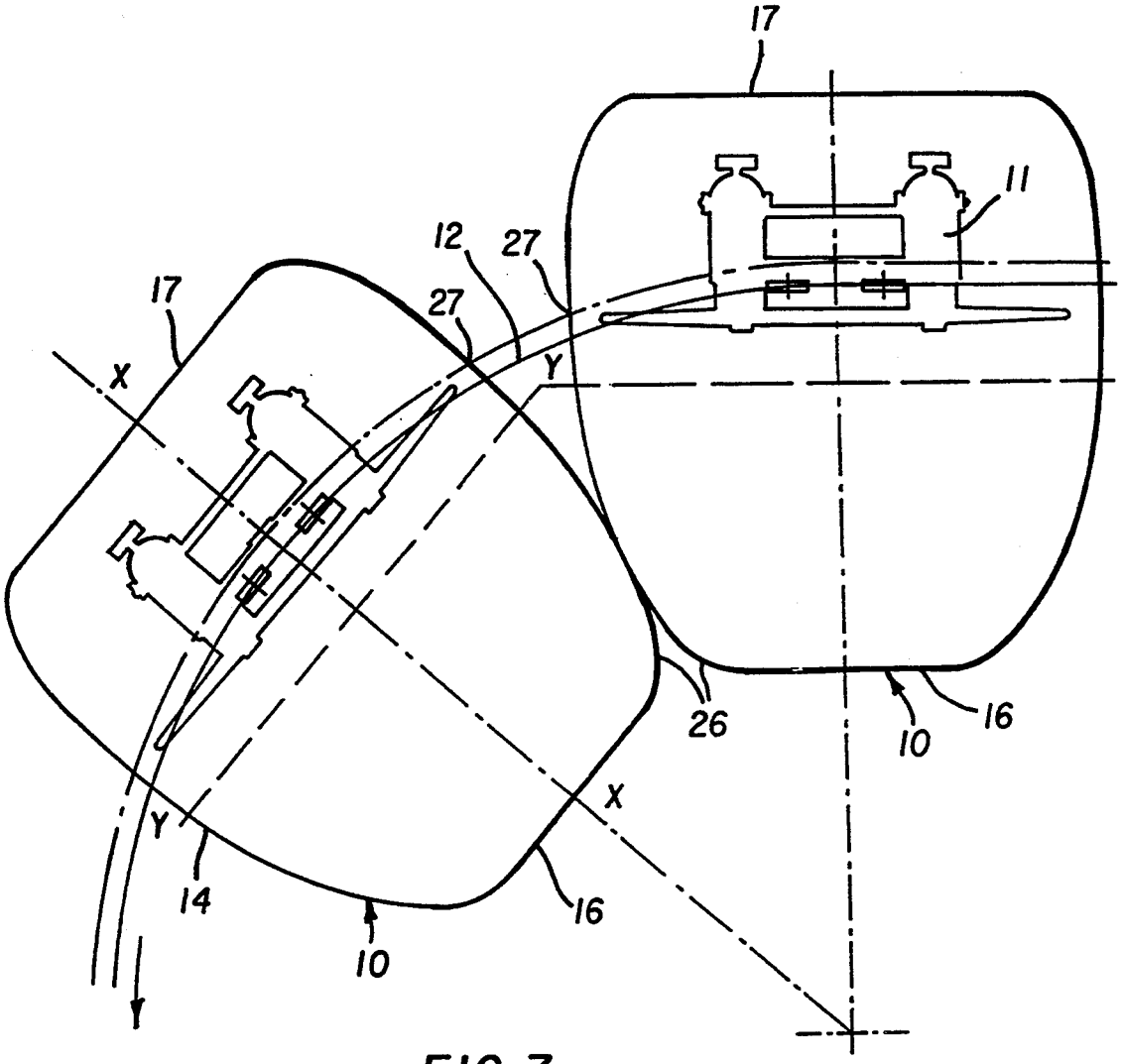
FIG. 3 is a schematic plan view of cabins travelling on the half-loop circuit.
Figure 4:
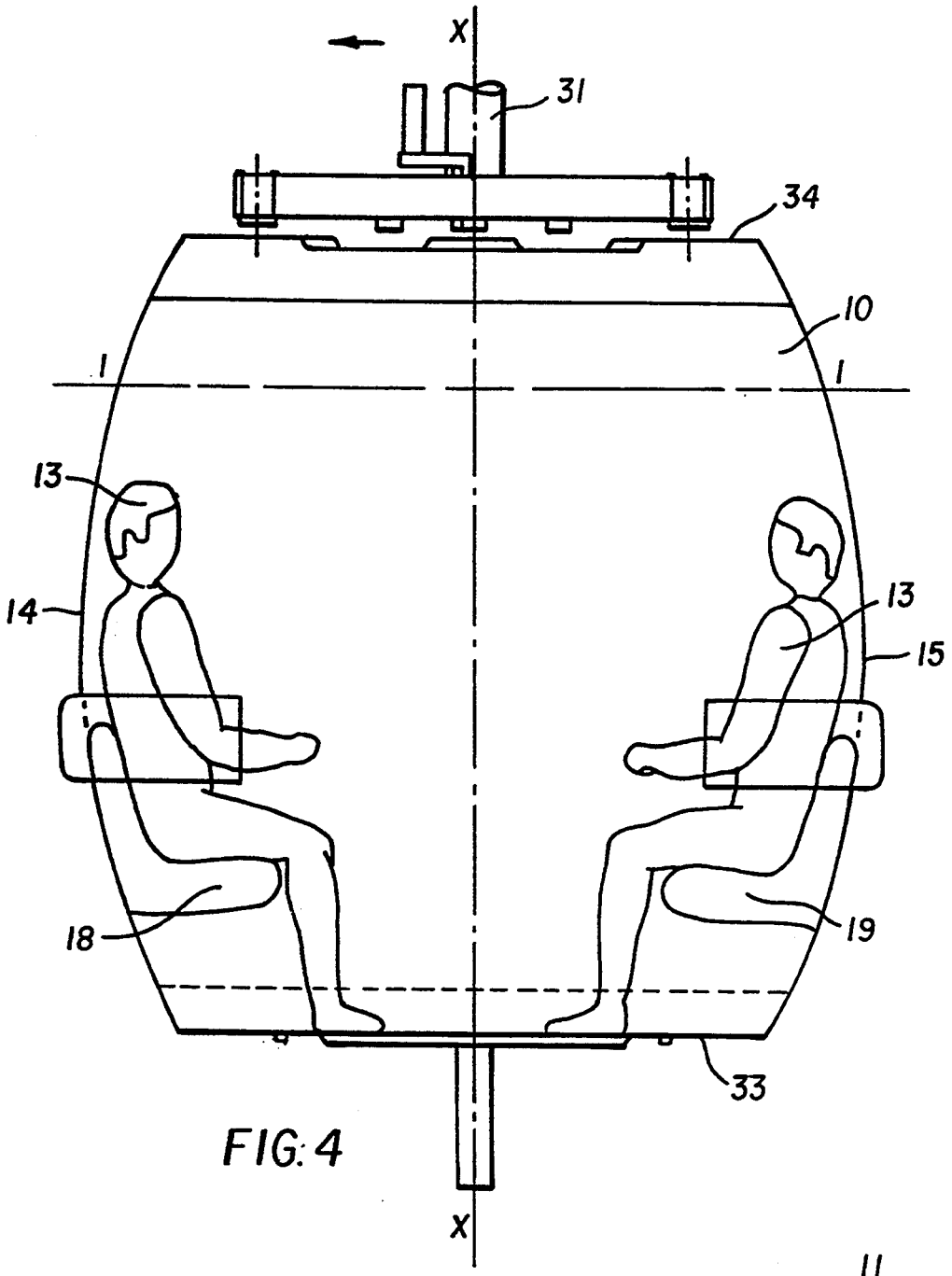
FIG. 4 shows a cross section taken along a line Y—Y of FIG. 1.

FIG. 3 shows a curved track portion of the half-loop circuit 12 and two of the successive cabins 10 which travel on this portion. The converging portion 26 of the rear side 15 of the first cabin is in contact with the converging portion 26 of the front side 14 of the second cabin, while the other portions 27 of the rear side 15 and front side 14, which are on the outerside of the curve, are clearly separated. It is clear that on the straight track portion these other portions 27 come substantially in contact, while the portions 26, on the innerside of the curve, are separated, and that these cabins cannot travel on a track portion curved on the other side. In the exemplary embodiment illustrated in FIG. 1 the convergence of the front and rear sides 14,15 is adapted to the radius of curvature of the curved rail section of the half-loop circuit, so that the mutual spacing of the cabins is substantially the same on curved and straight rail sections. When the embarking and disembarking sections are located on a straight rail portion, the cabins are close to one another so as to prevent accidents. It is to be understood that the invention is not limited thereto and extends to cabins wherein the convergence of the front and rear sides compensates partially the curvature of the track.

What is claimed is:

1. A cableway cabin for transport of passengers along a closed loop which includes a cable and a transfer rail extending along a curved section of the closed loop, comprising:

a cabin body including a floor, a roof, and outer walls joining said floor and roof to each other, said outer walls including a front wall, a rear wall, an outer lateral wall and an inner lateral wall, said outer and inner lateral walls joining said front and rear walls to each other;

an arm for connection of the cabin body to the closed loop;

a door provided along said outer lateral wall to allow passage of passengers into the cableway cabin; and front and rear seating means for seating passengers along said front and rear walls, respectively, said front and rear seating means having seat backs disposed along said front and rear walls, respectively, such that the passengers are seated to face each other;

wherein said cabin body is asymmetrical with respect to a first vertical median plane, said first vertical medium plane bisecting said front and rear walls and extending along the direction of travel of the cableway cabin along the closed loop, said outer lateral wall having a width greater than that of said inner lateral wall, and an area is provided between the front and rear seating means and adjacent the inner lateral wall which is just sufficient for feet of the passengers.

2. The cableway cabin of claim 1, wherein said cabin body is symmetrical with respect to a second vertical median plane, the second vertical median plane bisecting the outer and inner lateral walls and extending perpendicular to the direction of travel of the cableway cabin along the closed loop.

3. The cableway cabin of claim 1, wherein said front and rear walls extend substantially parallel to each other from said outer lateral wall to the first vertical median plane, and converge toward each other from the first vertical median plane to the inner lateral wall.

4. The cableway cabin of claim 1, wherein each of the front and rear walls is convex, and extends with increasing curvature toward the inner lateral wall, said front and rear seating means being spaced apart with an increasing distance toward the outer lateral wall to provide an increased area for feet of the passengers.

5. The cableway cabin of claim 1, wherein said door comprises two sliding door panels, the cableway cabin further comprising two ski racks respectively provided along a lower portion on an exterior side of the two sliding door panels.

6. The cableway cabin of claim 1, wherein said front and rear seating means comprise not less than six seats.

7. The cableway cabin of claim 1, wherein the width of the inner lateral wall is adapted to maintain the same mutual spacing between successive cableway cabins when traveling through the transfer rail.

* * * * *